US007322853B2

(12) United States Patent
Yang et al.

(10) Patent No.: US 7,322,853 B2
(45) Date of Patent: Jan. 29, 2008

(54) SOCKET CONNECTOR

(75) Inventors: Lanxuan Yang, Nanshan (CN); Zhiwu Chen, Nanshan (CN); Xunhua Xiao, Nanshan (CN)

(73) Assignee: Shenzhen Mindray Bio-Medical Electronics Co., Ltd. (CN)

( * ) Notice: Subject to any disclaimer, the term of this patent is extended or adjusted under 35 U.S.C. 154(b) by 0 days.

(21) Appl. No.: 11/530,040

(22) Filed: Sep. 8, 2006

(65) Prior Publication Data

US 2007/0249226 A1 Oct. 25, 2007

(30) Foreign Application Priority Data

Apr. 19, 2006 (CN) ..... 2006 2 0058159

(51) Int. Cl.
*H01R 13/648* (2006.01)

(52) U.S. Cl. ..... 439/607; 439/544; 439/939

(58) Field of Classification Search ..... 439/607, 439/544, 553, 939, 557, 108
See application file for complete search history.

(56) References Cited

U.S. PATENT DOCUMENTS 5,975,958 A * 11/1999 Weidler ..... 439/620.22
6,478,622 B1 * 11/2002 Hwang ..... 439/607
6,709,286 B1 * 3/2004 Korsunsky et al. ..... 439/557
7,077,696 B2 * 7/2006 Haga et al. ..... 439/553
7,211,739 B1 * 5/2007 Brigham et al. ..... 174/359
7,219,404 B2 * 5/2007 Haga et al. ..... 24/458

* cited by examiner

*Primary Examiner*—Hien Vu
(74) *Attorney, Agent, or Firm*—Schmeiser, Olsen & Watts

(57) ABSTRACT

A socket connector comprises a circuit board with a socket part mounted on the outside thereof; a socket shield part; a metal shield plate with a through-slot, on the outside of which the socket shield part is mounted; a shield shell with openings on the wall thereof, forming into a shield chamber for fitting a plug and arranged on the socket shield part; and elastic shielding sheets, snapped into the openings and protruding outwards from the openings, wherein the socket part is inserted into the shield chamber formed by the shield shell through the through-slot of the metal shield plate. The elastic shielding sheets can be easily mounted since they are snapped into the shield shell; due to protruding outwards, the elastic shielding sheets come into contact with the inner surface of the shell of the plug to enable shield when the plug is inserted, so that the surface of the shell of the plug will not be scratched; due to the providing of the metal shield plate, the partial shield around the socket part can achieved, resulting in that the stability of the transmission of the ultrasonic signal is secured.

3 Claims, 8 Drawing Sheets

SOCKET CONNECTOR

BACKGROUND OF THE INVENTION

The present invention relates to a socket connector and in particular to a socket connector for connecting an external sensor (such as probe) of medical instrument with a host computer.

FIGS. 1 and 2 illustrate a well-known probe connector. The probe connector comprises: a probe circuit board 100 with probe sockets 101 mounted thereon, a metal shelf 102, and elastic shielding sheets 103. The metal shelf 102 is provided with through-slots 1021 through which the probe sockets 101 pass. Each through-slot 1021 is provided with elastic shielding sheets 103 therearound. The metal shelf 102 is fixed on the front panel 105 of the host chassis. When a probe plug 106 is inserted, the bottom surface of the shell of the plug comes into contact with the elastic shielding sheets 103.

FIGS. 3 and 4 illustrate another well-known probe connector. The probe connector comprises: a probe circuit board 100, probe sockets 101, a metal shelf 102 and elastic shielding sheets 103. The metal shelf 102 is provided with through-slots 1021 through which the probe sockets 101 pass. Each through-slot 1021 is immovably provided with the elastic shielding sheets 103 around the inner wall thereof. When a probe plug 106 is inserted, the outer surface of the shell of the plug comes into contact with the elastic shielding sheet 103.

The above mentioned probe connectors have following defects:

1) Generally, the elastic shielding sheets are fixed on the shield metal pedestal of the connector by riveting, soldering process and the like;

2) The elastic shielding sheets are in contact with the outer surface or bottom surface of the shell of the plug, and the outer surface of the shell of the plug will be scratched because of the friction with the elastic shielding sheets during the frequent operations of plug-in and pull-out;

3) The contact area, being contact with the elastic shielding sheets, of the shell of the plug needs a surface polishing (or plating) process and the rest area of the shell needs a surface processing, such as spraying and the like, in order to ensure effective electrical contact between the elastic shielding sheets and the shell of the connector plug. Thus, the processes are relatively complex in view of mould manufacturing and product post-processing.

4) Partial shield for the printed circuit board of the probe (also called the probe PCB) can not be obtained around the connector plug, which influences the stability of the ultrasonic signal transmission.

5) The force of plug-in or pull-out is directly transferred to the probe circuit board via the probe socket during the frequent operations of plug-in or pull-out, which shortens the life of the circuit board or even destroys it.

SUMMARY OF THE INVENTION

Therefore, an object of the present invention is to provide a socket connector, which is easy to mount, will not scratch the surface of the plug and has a better shield effect, to overcome the defects of the prior art.

To achieve these and other advantages and in accordance with the purpose of the present invention, as embodied and broadly described herein, there is provided a socket connector comprising a circuit board; a socket part, mounted on outside of the circuit board; a metal shield plate with a through-slot; a socket shield part mounted in the through-slot and toward the outside of the metal shield plate, wherein the socket shield part includes: a shield shell with openings on the wall thereof; and elastic shielding sheets, each elastic shielding sheet having an end snapped into the openings toward inside of the shield shell, and having a portion protruding from the openings toward outside of the shield shell so that the portion of each elastic shielding sheet contacts with the inner surface of the shell of a plug, wherein the socket part is inserted into the shield chamber formed by the shield shell through the through-slot of the metal shield plate.

Preferably, said socket part is fixed on the metal shield plate by a mounting portion.

Preferably, the through-slot of said metal shield plate is a stepped slot including a first through-slot and a second through-slot connecting each other, the shape of the first through-slot matches the outline of the socket part, and the socket shield part is mounted in the second through-slot.

Preferably, two ends of said mounting portion are fixed in the second through-slot, with the arched middle part thereof fastened with the socket part as a whole.

The advantageous effects of the present invention lies in that, the elastic shielding sheets can be easily mounted since they are snapped into the shield shell; due to protruding outwards, the elastic shielding sheets come into contact with the inner surface of the shell of the plug to enable shield when the plug is inserted, so that the surface of the shell of the plug will not be scratched; due to the providing of the metal shield plate, the partial shield around the socket part can achieved, resulting in that the stability of the transmission of the ultrasonic signal is secured.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
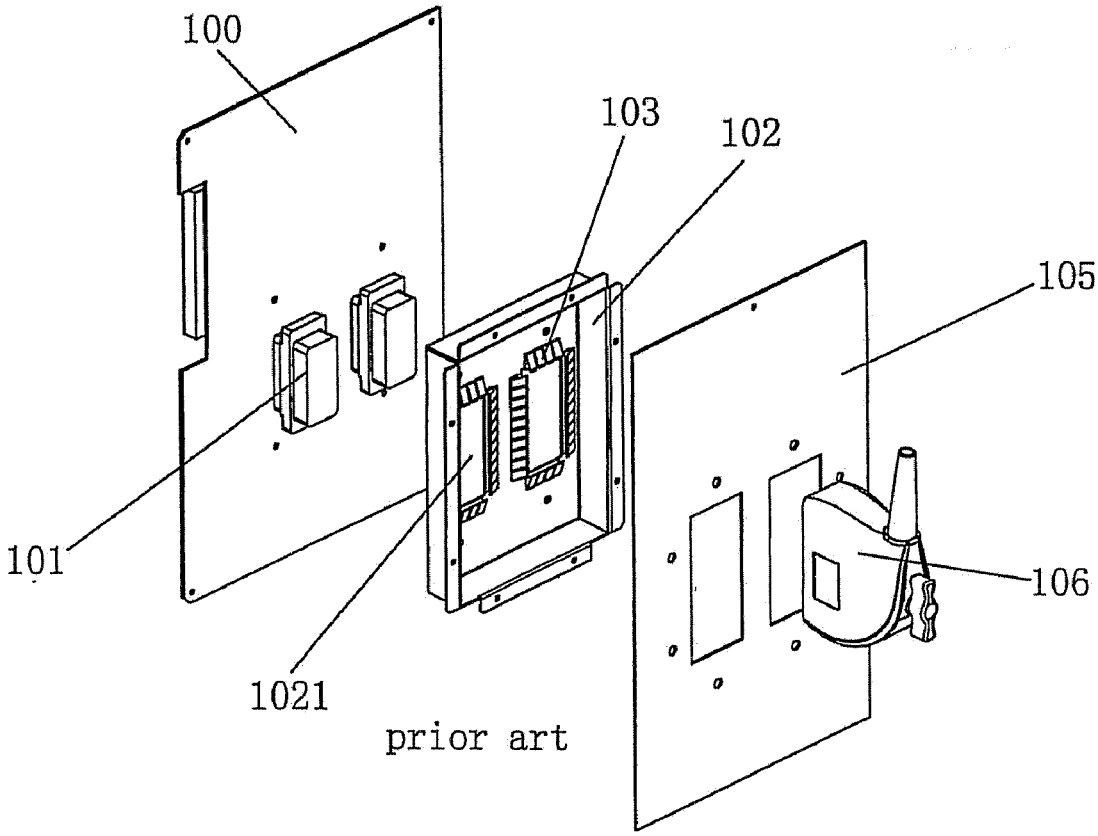
prior art FIG.1
FIG. 1 is an exploded perspective view of the first known probe connector.
Figure 2:
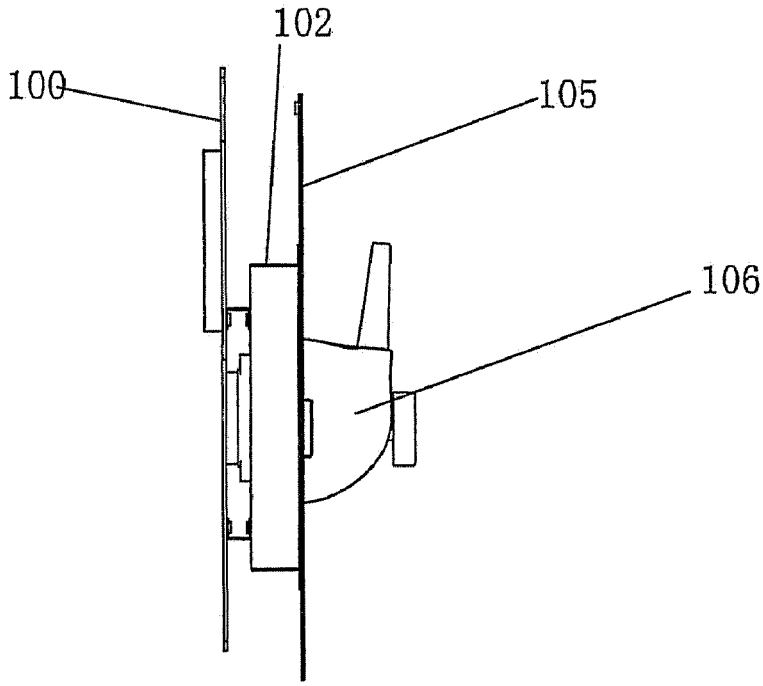
prior art FIG.2
FIG. 2 is a side view of the first known probe connector.
Figure 3:
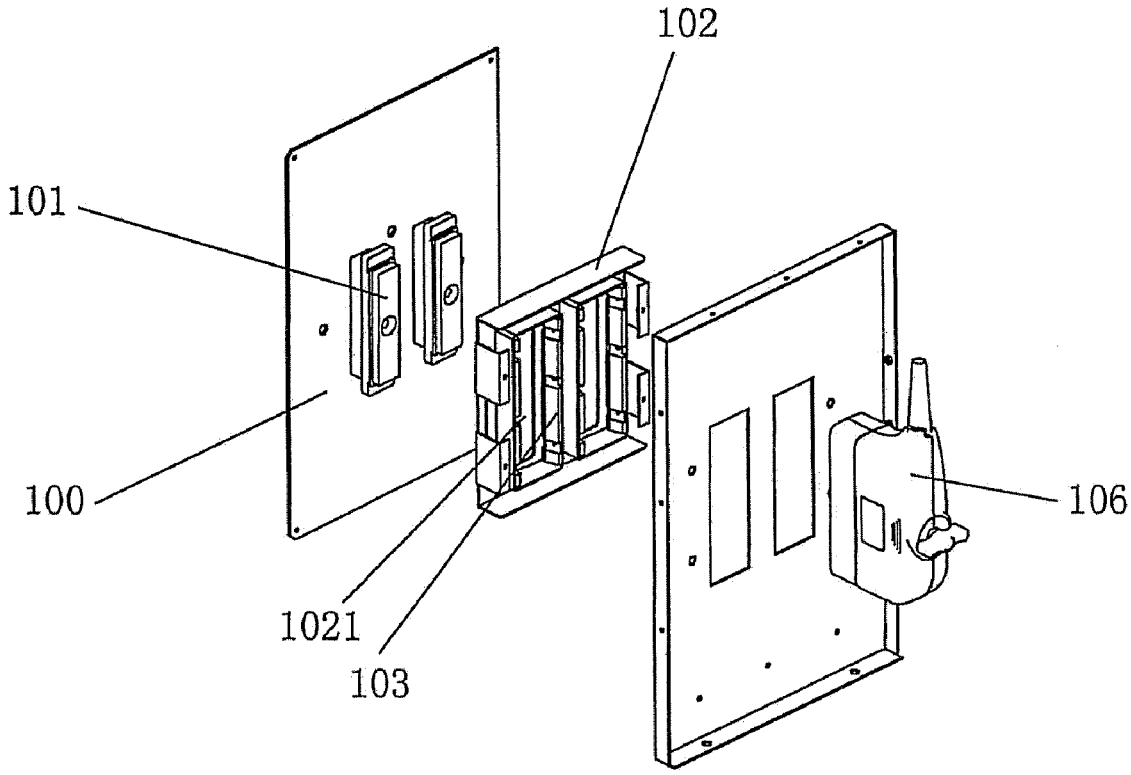
prior art FIG.3
FIG. 3 is an exploded perspective view of the second known probe connector.
Figure 4:
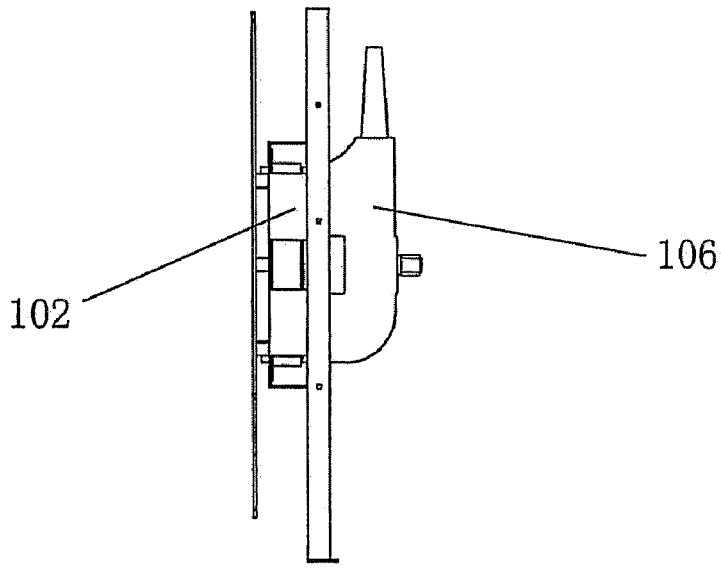
prior art FIG.4
FIG. 4 is a side view of the second known probe connector.
Figure 5:
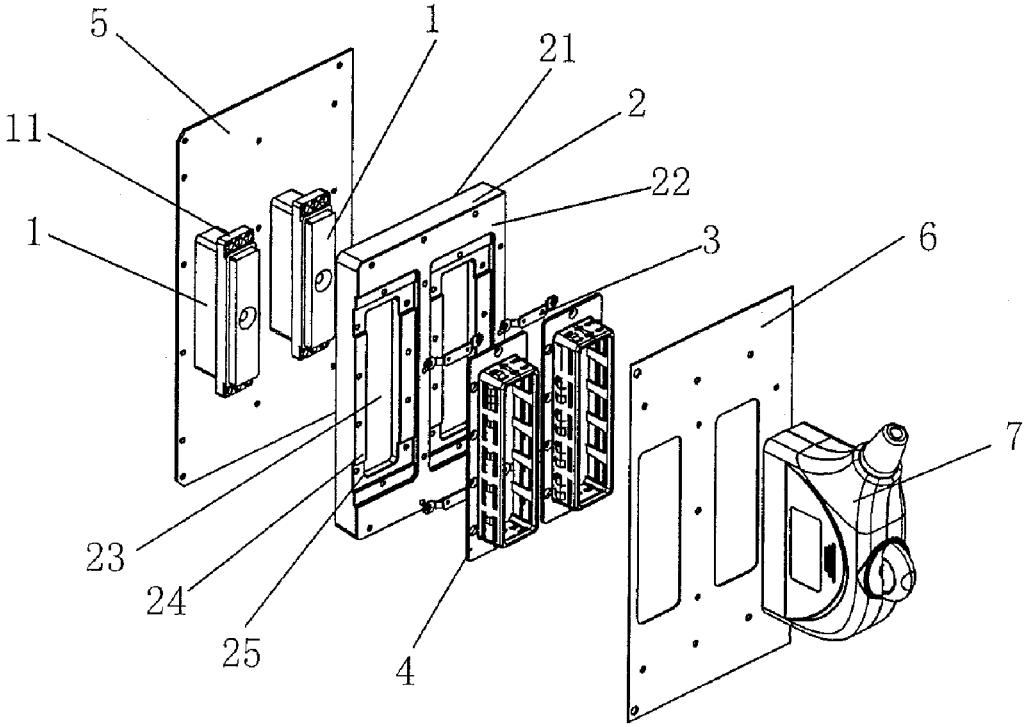
FIG. 5 is an exploded perspective view showing the state of the socket connector according to the present invention before assembling with the plug and the front panel.
Figure 6:
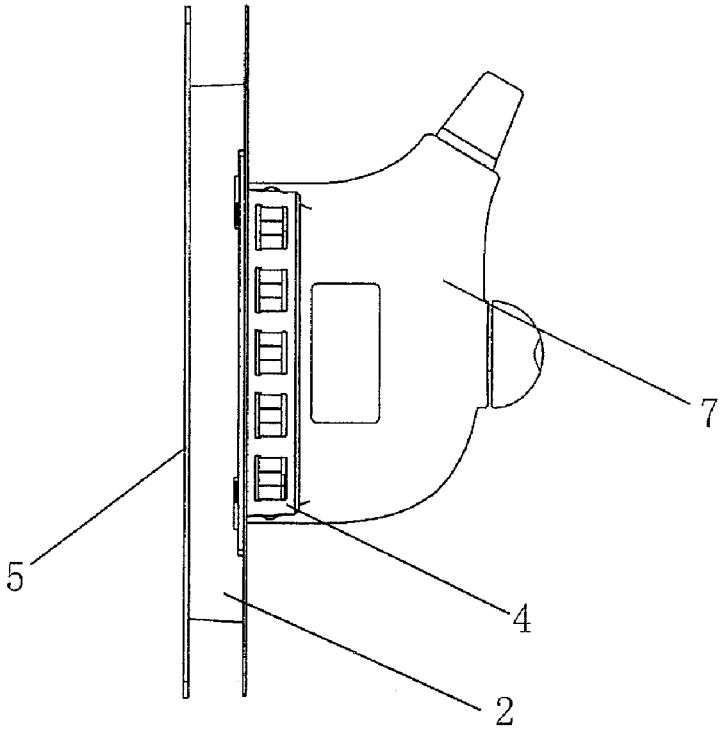
FIG. 6 is a side view showing the state of the socket connector according to the present invention after assembling with the plug and the front panel.
Figure 7:
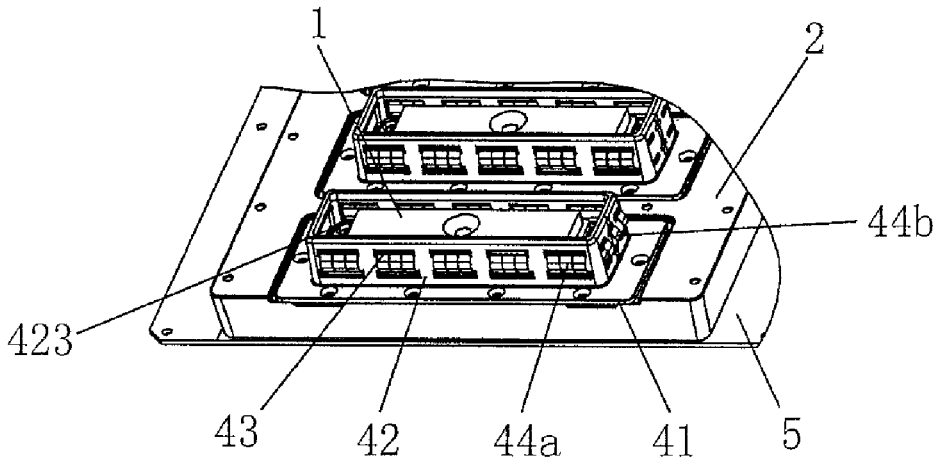
FIG. 7 is a perspective view of the socket connector according to the present invention.
Figure 8:
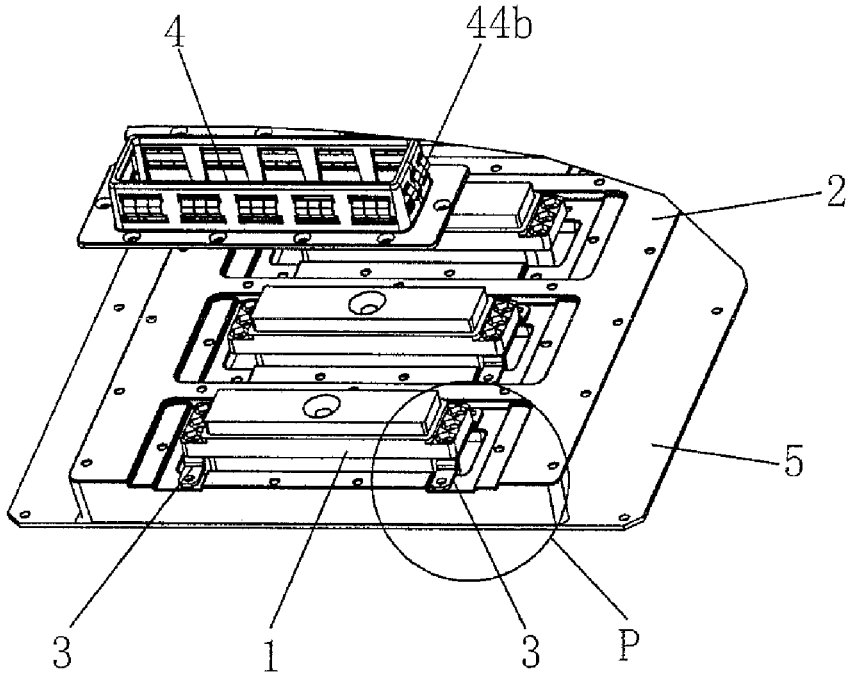
FIG. 8 is an exploded perspective view showing the state of the socket shield part of the socket connector according to the present invention after separating from the metal shield plate.
Figure 9:
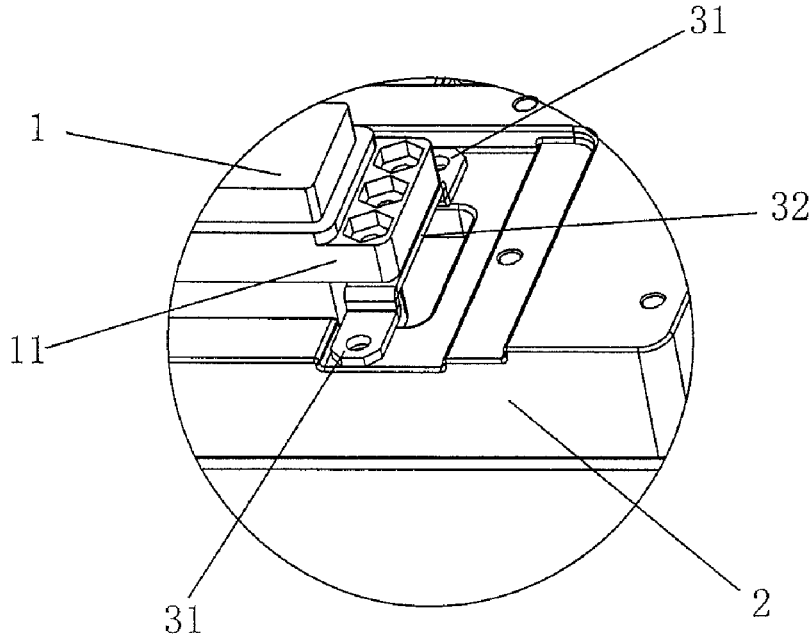
FIG. 9 is an enlarged partial view of the section indicated by P shown in FIG. 8.
Figure 10:
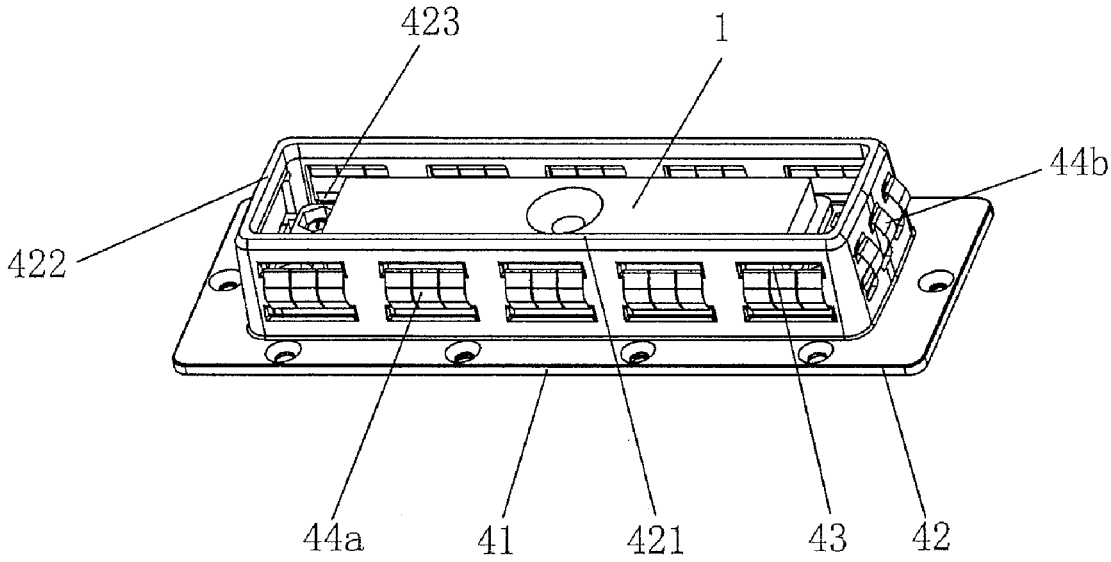
FIG. 10 is a perspective view showing the state of the socket shield part of the socket connector according to the present invention when fitting the metal shield plate.
Figure 11A:
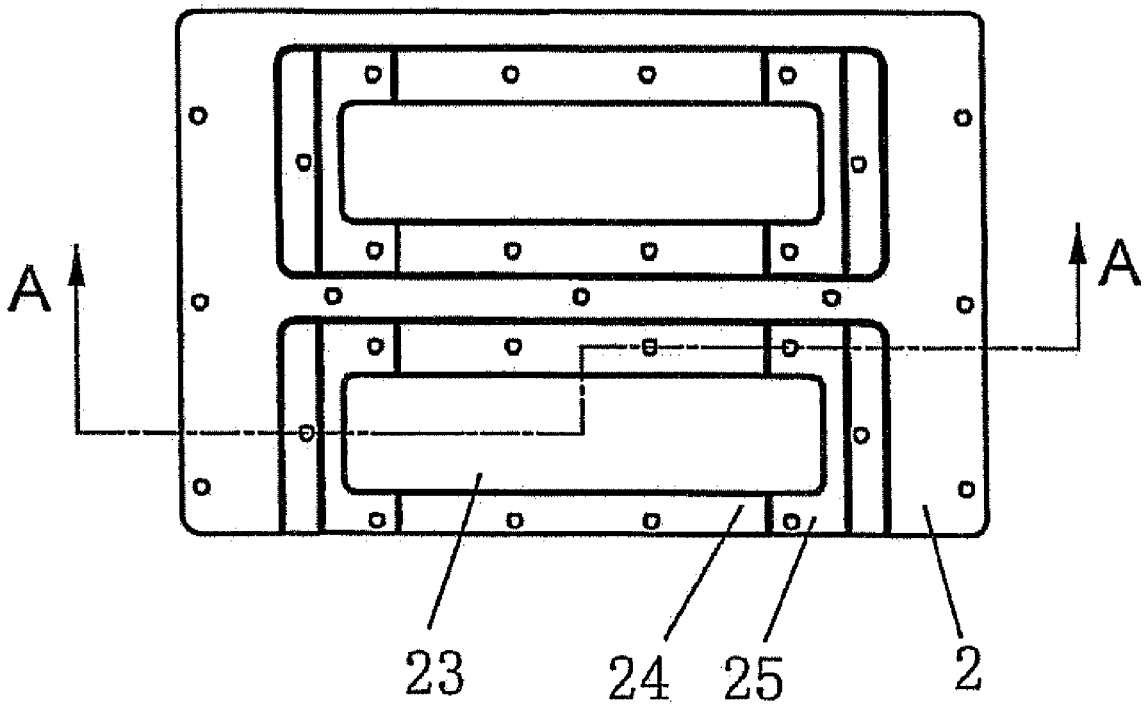
FIG. 11A is top plan view showing the state of the metal shield plate in accordance with the present invention.
Figure 11B:
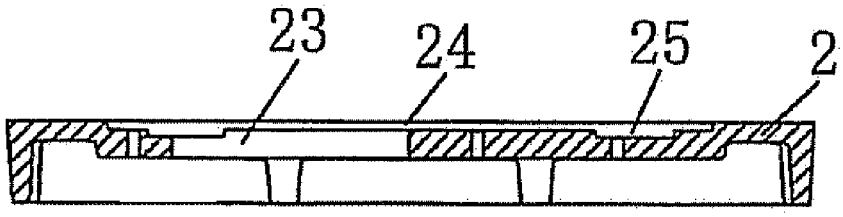
FIG. 11B is a cutaway view along the A-axis of FIG. 11A of the metal shield plate in accordance with the present invention.
Figure 12:
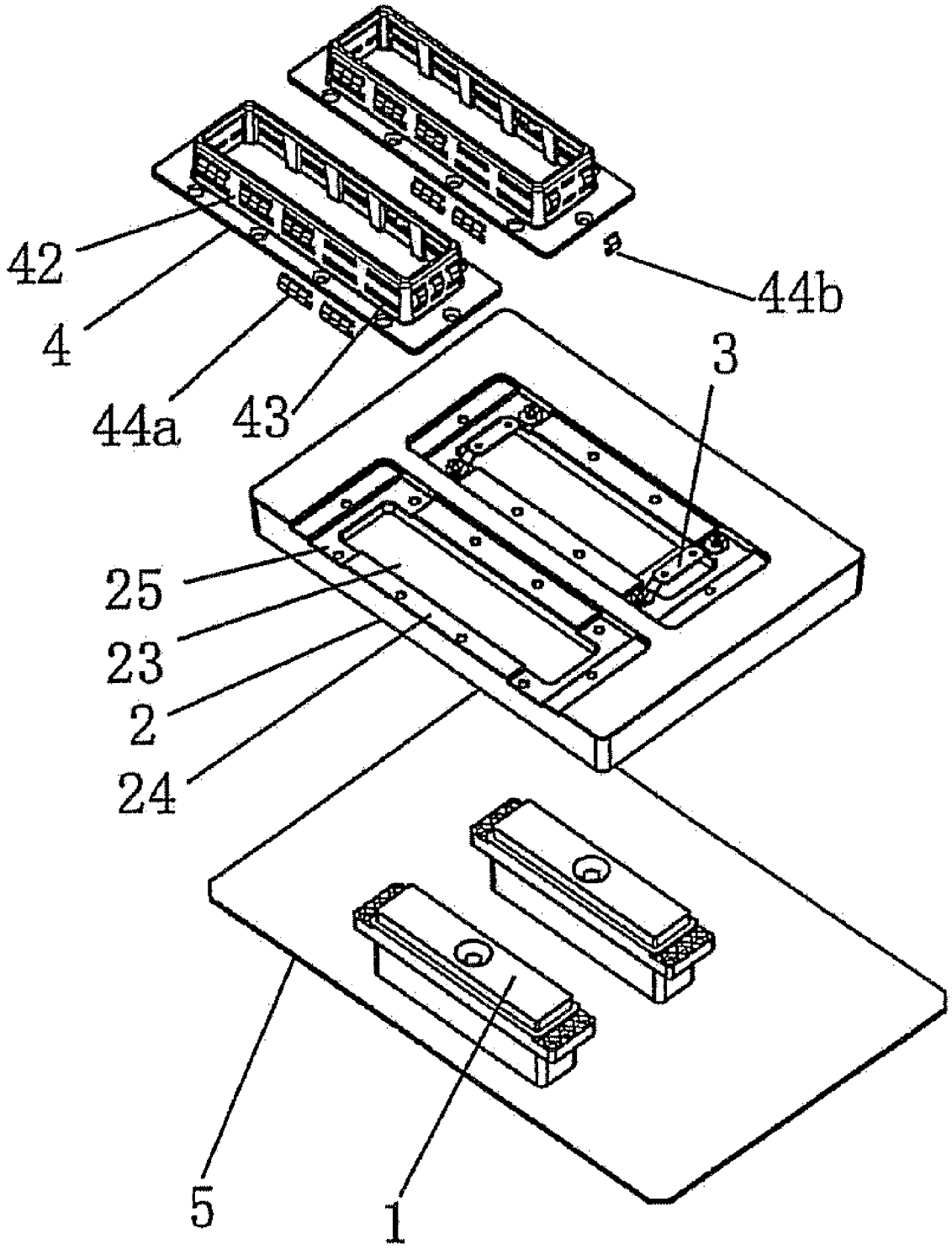
FIG. 12 is an exploded perspective top view of the socket connector in accordance with the present invention.
Figure 13A:
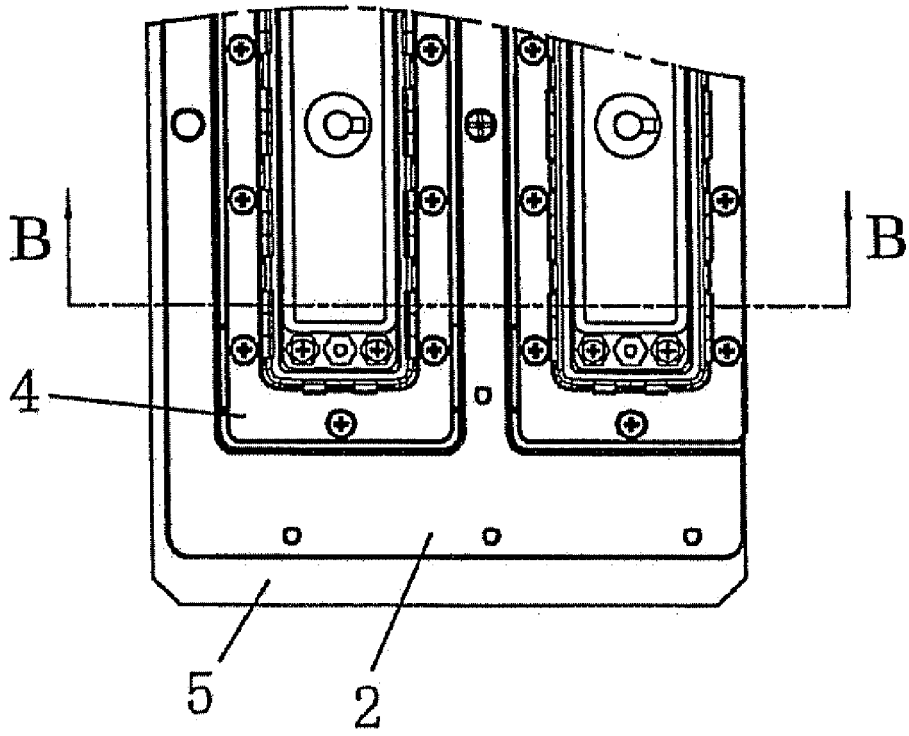
FIG. 13A is partial top view showing the metal shield plate with the socket shield and circuit board in accordance with the present invention.
Figure 13B:
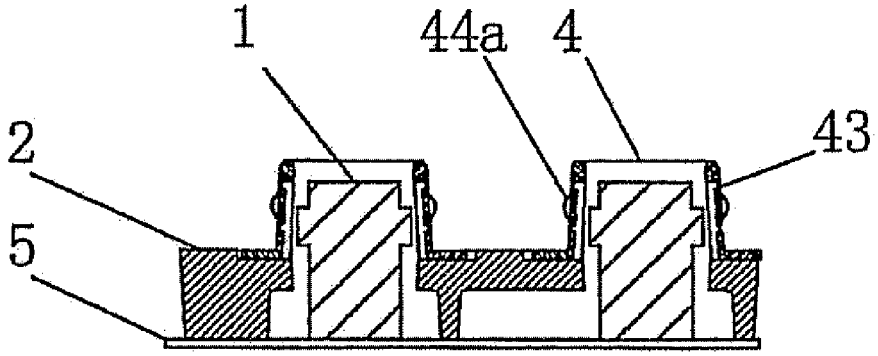
FIG. 13B is a cutaway view along the B-axis of FIG. 13A of the socket parts and socket shield connected to the metal shield plate and circuit board in accordance with the present invention.

With reference to FIGS. 5 to 13B, a socket connector in accordance with the present invention comprises a circuit board 5 with a socket part 1 mounted on the outside thereof, and a socket shield part 4, the socket connector further comprises: a metal shield plate 2 with a through-slot, on the outside of which the socket shield part 4 is mounted; a shield shell 42 with openings on the wall thereof, forming into a shield chamber 423 for fitting a plug 7 and arranged on the socket shield part 4; and elastic shielding sheets 44*a-b*, snapped into the openings and protruding outwards from the openings, wherein the socket part 1 is inserted into the shield chamber 423 formed by the shield shell 42 through the through-slot of the metal shield plate 2.

Socket parts 1, having a shape of strip substantially, are mounted on the circuit board 5, and the socket part 1 includes tabs 11 formed in the middle thereof. The metal shield plate 2, which is made of aluminum, has a first surface 21 facing circuit board 5 and a second surface 22 facing socket shield part 4, the first surface 21 being parallel to the second surface 22. The metal shield plate 2 is also provided with at least one stepped through-slot, which perforates through the first surface 21 and second surface 22, the number of the through-slots corresponding to that of the socket parts. The stepped through-slot includes a first through-slot 23 with relatively small size and a second through-slot 24 with relatively large size. The shape of the first through-slot 23 matches the outline of the socket part 1. Mount slots 25 are concavely formed on the bottom of the second through-slot 24. Two mount slots 25 are mounted with two mounting portions 3 respectively, and two ends 31 of each mounting portion 3 are fixed in the corresponding mount slot 25 utilizing screws, and the middle part 32 of the mounting portion 3 arches.

The socket shield part 4 comprises a mount plate 41, a shield shell 42, and elastic shielding sheets 44*a* and 44*b*. The mount board 41 is fixed in the second through-slot 24 of the metal shield plate 2 with the through-slot through which the socket part 1 traverses. The shield shell 42 extends to the front panel 6 of the host chassis in the direction vertical to the mount board 41, and each wall 421 in the length direction of the shield shell 42 is provided with three openings 43, three pieces of elastic shielding sheets 44*a* snapping into each opening 43. Each wall 422 in the width direction of the shield shell 42 is provided with three openings 43, a piece of elastic shielding sheet 44*b* snapping into each opening 43. Two ends of each of elastic shielding sheets 44*a* and 44*b* are snapped into the inboard of the openings 43, with the middle part of the elastic shielding sheet 44*a-b* arching towards the outside of the openings 43.

When the socket connector is mounted, the two mounting portions 3 are fixed in the two mount slots 25 of the metal shield plate 2, the socket parts 1 are encased by the through-slots of the metal shield plate 2 with the middle parts 32 of the mounting portions 3 pressing against the tabs 11 of the socket parts 1, and each tab 11 and each mounting portion 3 are fastened as a whole with fasteners, so that the two ends of each socket part 1 are respectively fixed on the metal plate 2 by each mounting portion 3.

After the socket connector is mounted, the metal shield plate 2 covers the circuit board 5 and surrounds the socket parts 1, and the socket shield part 4 is fixed on outsides of the metal shield plate 2; the socket parts 1 traverse through the through-slots of the metal shield plate 2 and are inserted into shield chambers 423 formed by the shield shells 42 respectively; the metal shield plate 2 is fixed with the front panel 6 of the host chassis. When a plug 7 is plugged in the socket connector, the arched surfaces of the elastic shielding sheets 44*a* and 44*b* come into contact with the inner surface of the shell of the plug 7 to enable shield.

The socket connector according to the present invention has wide applications in fields of movement control of machines, medical diagnostic equipments, automatic control of equipments, video editing and producing facilities, medical imaging systems, industrial and scientific apparatus, testing and measuring equipments, electromechanic microscope and visual systems, CAD/CAM/CAE and computer graphics equipments and so on.

According to the present invention, the elastic shielding sheets 44*a* and 44*b* are manually snapped into the openings 43 of the socket shield part 4, so it is easy to mount. The elastic shielding sheets 44*a* and 44*b* achieve shield by contacting with the inner surface of the shell of the plug 7, so the outer surface of the plug shell will not be scratched. Thus, the outer surface of the plug shell only needs a surface processing, such as spraying and the like, so the working procedure is simplified.

Furthermore, since two ends of each socket part 1 are respectively fixed on the metal shield plate 2 by the mounting portion 3, the force of plug-in or pull-out is transferred to the fixed metal shield plate 2 through the two mounting portions 3 when plug 7 is plugged in or pulled out, so that the circuit board 5 will not subject to the force directly, eliminating the quality risk.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalents of such metes and bounds are therefore intended to be embraced by the appended claims.

We claim:

1. A socket connector for inserting a plug thereon, comprising:

a circuit board;

a socket part mounted on outside of the circuit board;

a metal shield plate with a through-slot; and a socket shield part mounted in the through-slot and towards the outside of the metal shield plate, wherein the socket shield part includes:

a shield shell forming a shield chamber, wherein openings are provided on a wall of the shield shell; and elastic shielding sheets, each elastic shielding sheet having an end snapped into the openings towards the inside of the shield shell, and having a portion protruding from the openings towards the outside of the shield shell so that a portion of each elastic shielding sheet contacts with an inner surface of the plug, wherein the socket part is inserted into the shield chamber formed by the shield shell through the through-slot of the metal shield plate, wherein said socket part is fixed on the metal shield plate by a mounting portion having mounting fasteners.

2. The socket connector according to claim 1, wherein the through-slot of said metal shield plate is a stepped slot including a first through-slot and a second through-slot connecting each other, the shape of the first through-slot matches the outline of the socket part, and the socket shield part is mounted in the second through-slot.

3. The socket connector according to claim 2, wherein two ends of said mounting portion are fixed in the second through-slot with an arched middle part thereof fastened with the socket part.

* * * * *